US005375907A

United States Patent [19]

Rogers et al.

[11] Patent Number: 5,375,907

[45] Date of Patent: Dec. 27, 1994

[54] SOFA TABLE AND MECHANISM

[75] Inventors: W. Clark Rogers, Denton; D. Stephen Hoffman, High Point, both of N.C.

[73] Assignee: Ultra-Mek, Inc., Denton, N.C.

[21] Appl. No.: 922,563

[22] Filed: Jul. 30, 1992

[51] Int. Cl.[5] ..... A47C 17/04

[52] U.S. Cl. ..... 297/113; 297/188.15; 297/188.07; 297/411.33

[58] Field of Search ..... 297/417, 191, 411, 146, 297/238, 113, 411.33; 5/43, 45, 46, 12.1, 13

[56] References Cited

U.S. PATENT DOCUMENTS

| | | | |
|---|---|---|---|
| 3,666,319 | 5/1972 | Moloney | 297/113 |
| 3,951,448 | 4/1976 | Hawie | 297/191 X |
| 4,558,901 | 12/1985 | Yokoyama | 297/113 |
| 4,579,384 | 4/1986 | Sharod | 297/113 |
| 4,779,923 | 10/1988 | Lang et al. | 297/113 X |
| 5,104,182 | 4/1992 | Rasnick et al. | 297/113 |

FOREIGN PATENT DOCUMENTS

| | | | |
|---|---|---|---|
| 284491 | 2/1928 | United Kingdom | 297/113 |
| 438897 | 11/1935 | United Kingdom | 297/113 |

*Primary Examiner*—Peter M. Cuomo
*Assistant Examiner*—Jerry Redman
*Attorney, Agent, or Firm*—Bell, Seltzer, Park & Gibson

[57] ABSTRACT

A mechanism suitable for use with a retractable sofa table adapted for mounting the mechanism to a sofa frame, a lower pivot link pivotally interconnected to the mounting element, a table mounting bracket pivotally interconnected to the lower pivot link configured to be fixed to the table section, and an upper pivot link pivotally interconnected to the mounting element, and further pivotally interconnected to the table mounting bracket is disclosed. The upper pivot link includes between its pivots a bend disposed toward the lower pivot link which is configured to accept the profile of a sofa table.

26 Claims, 3 Drawing Sheets

SOFA TABLE AND MECHANISM

FIELD OF THE INVENTION

The present invention relates generally to movable sofa tables, and relates more specifically to an improved mechanism for a retractable sofa table.

FIELD AND BACKGROUND OF THE INVENTION

Many sofa models include a retractable sofa table, which is a device that folds from an upright position within a recessed area in the backrest of the sofa to a horizontal position resting just above or upon the seating surface of the sofa, where it can serve as a table surface. See, e.g., U.S. Pat. No. 5,104,182 to Rasnick et al. Sofa tables are generally moved between these positions by some type of mechanism that is attached to the table itself and to some solid support within the backrest. Sofa tables have proven quite popular with consumers, who appreciate the convenience of having a table surface integrated into the sofa for storage of drinks, easy access of reading materials, and the like.

However, to date sofa tables have been unable to overcome certain shortcomings which have limited their use to specific sofa styles. The major shortcomings lie in the mechanism used to control the movement of the sofa table. Known mechanisms, such as that illustrated in Rasnick et al., are exposed visually in the open position to an observer facing the front surface of the backrest; these exposed linkages are aesthetically unpleasing- In addition, the mechanisms known to date are designed so that the thickness of the table section, including the table surface and the cushioned upholstered surface on the opposite surface of the table, is somewhat limited. This of course restricts the use of sofa tables to certain styles of sofas in which relatively thin cushions are used for the backrest. A further limitation of present sofa tables is the forward-to-rearward length of the table surface. Clearly, this dimension is limited by the height of the backrest and the mounting position of the mechanism. See Rasnick et al., supra, in which the mechanism is mounted approximately level with the upper surface of the table. However, prior art mechanisms have not taken full advantage of the space available within the cavity of the sofa backrest; in particular, the storage volume beneath the backrest and directly rearward of the seat has not been utilized.

It is therefore an object of the present invention to provide a mechanism suitable for use with a sofa table which is not visible in the open position to an observer facing the backrest cushion. It is a further object of the present invention to provide a sofa table and accompanying mechanism which are configured to permit the use of thicker sofa table units. It is an additional object to provide a mechanism which permits the use of a sofa table which is longer from front-to-rear than those currently known in this art.

SUMMARY OF THE INVENTION

These objects and others are satisfied by the present invention, which as a first aspect provides a mechanism suitable for use with a retractable sofa table comprising means adapted for mounting the mechanism to a sofa frame, a lower pivot link pivotally interconnected to the mounting means, a table mounting bracket pivotally interconnected to the lower pivot link and configured to be fixed to a sofa table unit, and an upper pivot link pivotally interconnected to the mounting means, and further pivotally interconnected to the table mounting bracket. The upper pivot link includes between its pivot a bend disposed toward the lower pivot link which is configured to accept within the bend the profile of a sofa table.

A second aspect of the present invention is a mechanism suitable for use with a retractable sofa table comprising means adapted for mounting the mechanism to a sofa frame, a lower pivot link pivotally interconnected to the mounting means, a table mounting bracket pivotally interconnected to the lower pivot link and configured to be fixed to a sofa table unit, and an upper pivot link pivotally interconnected to the mounting means and further pivotally interconnected with the table mounting bracket. The mounting means and upper pivot link are configured so that in an open position, all of the mechanism lies beneath a plane defined by the upper surface of an attached sofa table.

A third aspect of the present invention is a sofa table having an upper support surface, the upper support surface including a hinged storage compartment.

DETAILED DESCRIPTION OF THE INVENTION

The present invention will now be described more particularly hereinafter with reference to the accompanying drawings, in which present embodiments of the invention are shown. The invention, can, however, be embodied in many different forms and should not be limited to the embodiments set forth herein; rather, these embodiments are provided so that this disclosure will be thorough and complete, and will fully convey the scope of the invention to those skilled in the art.

Figure 1:
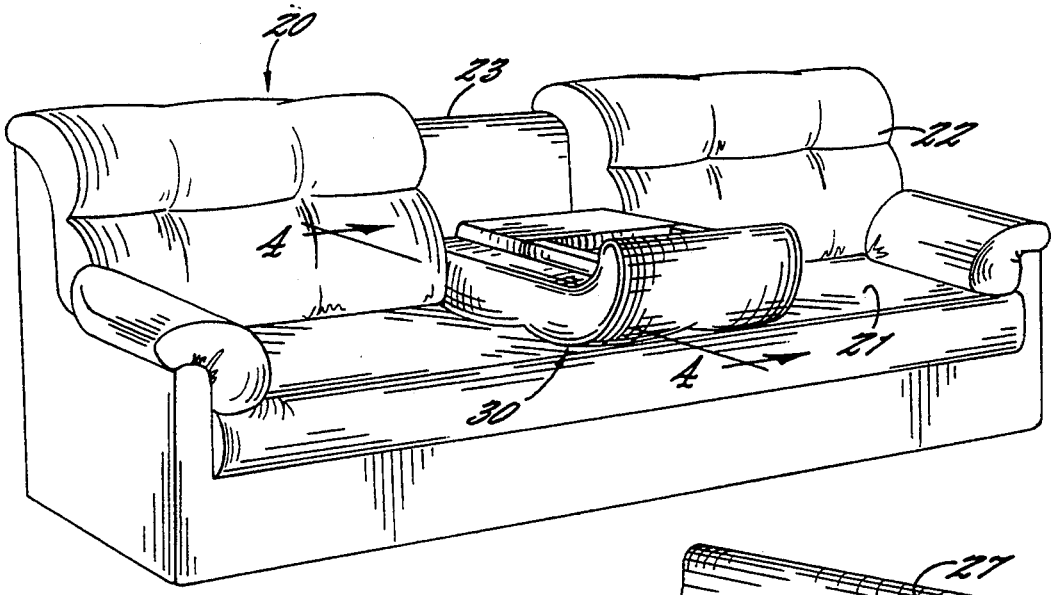
FIG. 1 shows a perspective view of a sofa having a sofa table, the sofa table being in the open position.
Figure 2:
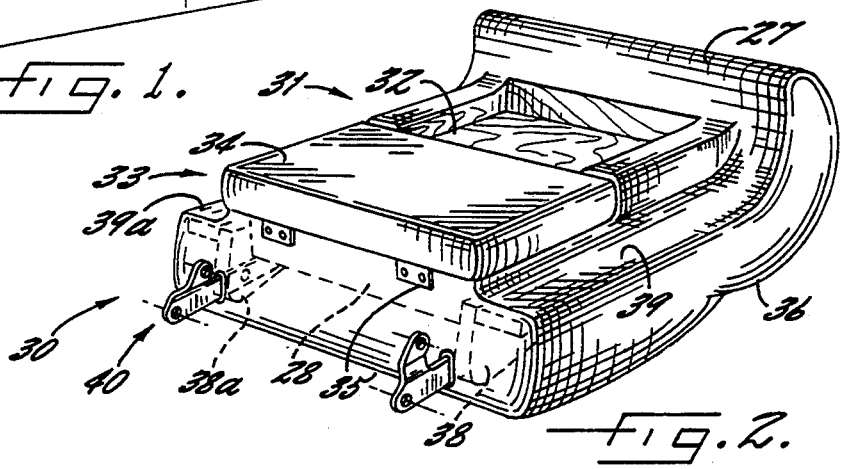
FIG. 2 shows a perspective view of a sofa table showing a recessed compartment and a hinged compartment.
Figure 3:
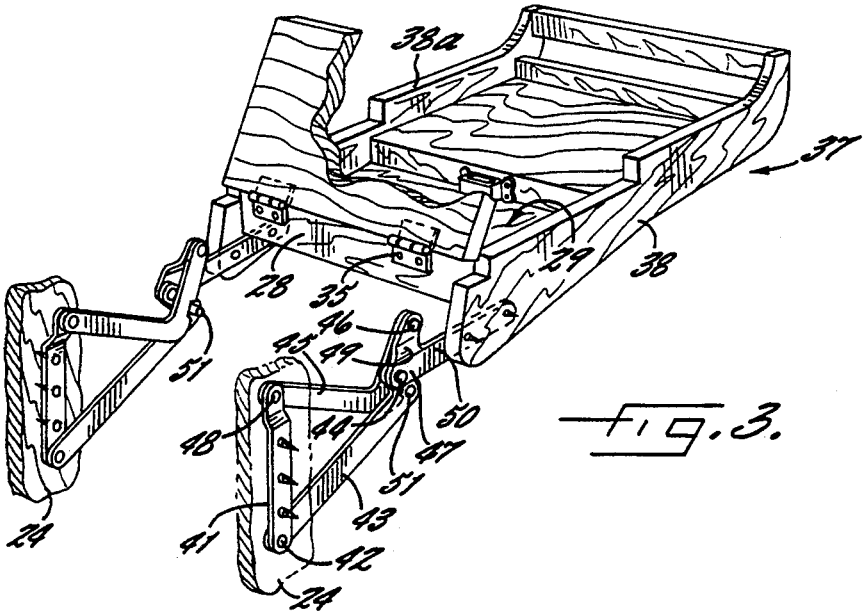
FIG. 3 is cut-away view of a sofa table frame and a mechanism connecting the sofa table to side panels of a sofa.

A current embodiment of the invention is shown in FIGS. 1–5. A sofa, broadly designated at 20, is shown in FIG. 1. The sofa includes a seat surface 21, a back surface 22 and a recessed area 23. Lining the vertical edges of the recessed area 23 are a pair of side panels 24, **24*a*. Within the recessed area 23 fits a sofa table 30 which is attached to side panels 24, 24*a* by a pair of mechanisms 40. It is noteworthy that the mechanisms 40 are mounted on the lower portion of the side panels 24, 24*a* which reside beneath the backrest 22 and just rearward of and below the seat surface 22**. While a sofa is illustrated herein, it will be appreciated by those skilled in this art that any type of seating unit, including a chair, love seat, pit sofa, and the like having a backrest and a seat is suitable for use with the sofa table and mechanism described herein.

The sofa table 30 (FIG. 2) includes a frame 37 (FIG. 3) which includes a pair of lateral side panels 38 to which are attached a pair of arm rests 39, 39*a*. The downwardly facing surface of the sofa table 30 (as seen in the open position shown in FIG. 4) comprises an upholstered surface 36; the opposite upwardly facing surface comprises an upholstered upper support surface 31, which includes a planar rectangular recessed compartment 32 and a storage compartment 33. The storage compartment 33 comprises a container portion 29, a upholstered lid 34 and a pair of hinges 35. The hinges 35 are fixed to the frame 37 at its rear edge 28. At the forwardmost edge of the sofa table 30 is an arcuate portion 27 which conforms to the top portion of the recessed area 23 of the sofa 20 when the sofa table 30 is in the closed position.

A pair of sofa mechanisms 40 connect the sofa 20 with the sofa table 30. The mechanisms are mirror images of one another about a vertical plane through the center of the sofa table 30 parallel to the side panels 38, 38*a*. For clarity, only one of the pair of mechanisms 40 will be described in detail herein.

The sofa mechanism 40 is fixedly mounted by a mounting link 41 to the backrest side panel 24 of the sofa, although those skilled in this art will appreciate that any means for mounting the mechanism to the backrest side panel 24, such as bolts or screws which provide pivot points for links interconnected to the side panel 24, is suitable for use with the present invention. The mechanism 40 comprises the mounting link 41, a lower pivot link 43, an L-shaped upper pivot link 45 and a mounting bracket 47. The lower pivot link 43 is pivotally interconnected to the mounting link 41 at pivot 42. The lower pivot link 43 also includes a stop pin 51 on its interior surface. The upper pivot link 45 is pivotally connected to the mounting link 41 at pivot 48. The mounting bracket 47 includes a pivot arm 49, and a table arm 50. The mounting bracket 47 is pivotally interconnected to the upper pivot link 45 at one end of the pivot arm 49 at pivot 46 and is further pivotally interconnected at the other end of the pivot arm 49 to the lower pivot link 43 at pivot 47. The table arm 50 is fixed to the interior surface of the side panel 38 of the sofa table 30.

Figure 5:
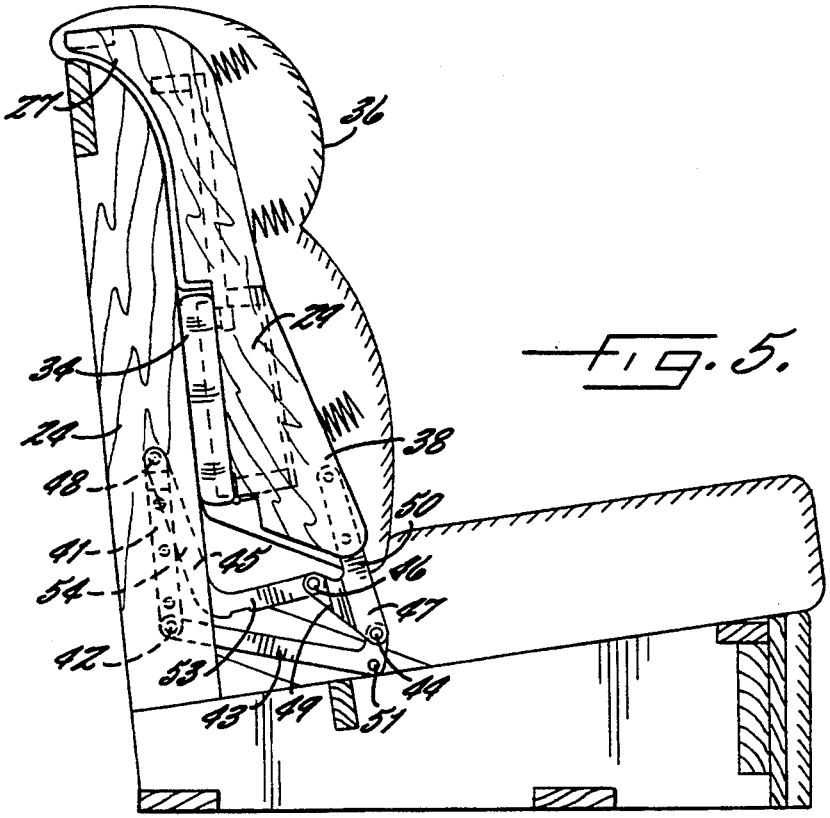
FIG. 5 is a side view of a sofa table and mechanism in a closed position.

The upper pivot link 45 as illustrated is L-shaped, which is an advantageous configuration in its interaction with the sofa table 30, particularly when combined with the low mounting location of the mounting link 41 on the side panel 24. As seen in FIG. 5, in the closed position, a first portion 53 of the upper pivot link 45 is disposed beneath the rear edge 28 of the sofa table 30, and a second portion 54 of the upper pivot link 45 is disposed rearward of the upper support surface 31 of the sofa table 30; in essence, the upper pivot link 45 "wraps around" the lower edge 28 and upper support surface 31 of the sofa table 30. Because the vertex of the "L" is disposed toward the lower pivot link 43, a cavity is provided in which the lower edge 28 of the sofa table 30 can reside in the closed position. Those skilled in this art will appreciate that, because the storage cavity described extends into the space below the backrest 22 and rearward of and below the seat surface 21, the storage cavity is enlarged over prior art models. Consequently, the upper support surface 31 can be lengthened to fill this enlarged cavity, thereby providing a larger table surface for the occupant. In addition, the armrests 39, 39*a* can be lengthened rearwardly for greater seating comfort.

Further, the L-shape of the upper pivot link 45 also causes the aforementioned storage cavity formed in the vertex of upper pivot link 45 to be able to retain a thicker sofa table 30 than prior sofa table mechanisms. This provides the furniture designer with the option of including a storage compartment 33 which is sufficiently deep to be useful to the occupant while still retaining a sufficiently thick cushion beneath upholstered surface 36 that occupant comfort is not compromised. The container portion 29 of the storage compartment 33 is sufficiently deep that it can be used to store items within, such as reading or writing materials, playing cards, television or stereo remote control devices, and the like.

This lengthening of the upper support surface 31 and the armrests 39, 39*a* and the thickening of the sofa table 30 can be accomplished simultaneously with inboard mounting of the table arm 50 of the mounting bracket 47 on the side panel 38 (i.e., the table arm 50 is mounted to the interior surface of the side panel 38). Inboard mounting of the table arm 50 and low mounting of the mounting link 41 on the side panel 24 removes virtually all of the linkages of the mechanism 40 from the view of an onlooker facing the front surface of the backrest 22, even when the sofa table 30 is in the open position, and therefore provides an aesthetically more appealing sofa.

Those skilled in this art will appreciate that, although the upper pivot link 45 is illustrated as L-shaped, it can take any configuration that includes therein a bend disposed toward the lower pivot link 45 in the closed position, such as C-shaped, V-shaped, U-shaped, obtuse-angled, and the like, and retain the advantages described herein. Further, a straight upper pivot link 45 could be employed with this mechanism, but would require either a shorter upper table surface 31 an exposed outboard mounting over the armrests 39, 39*a*, or a lower mounting location of mounting link 41 on side panel 24.

Figure 4:
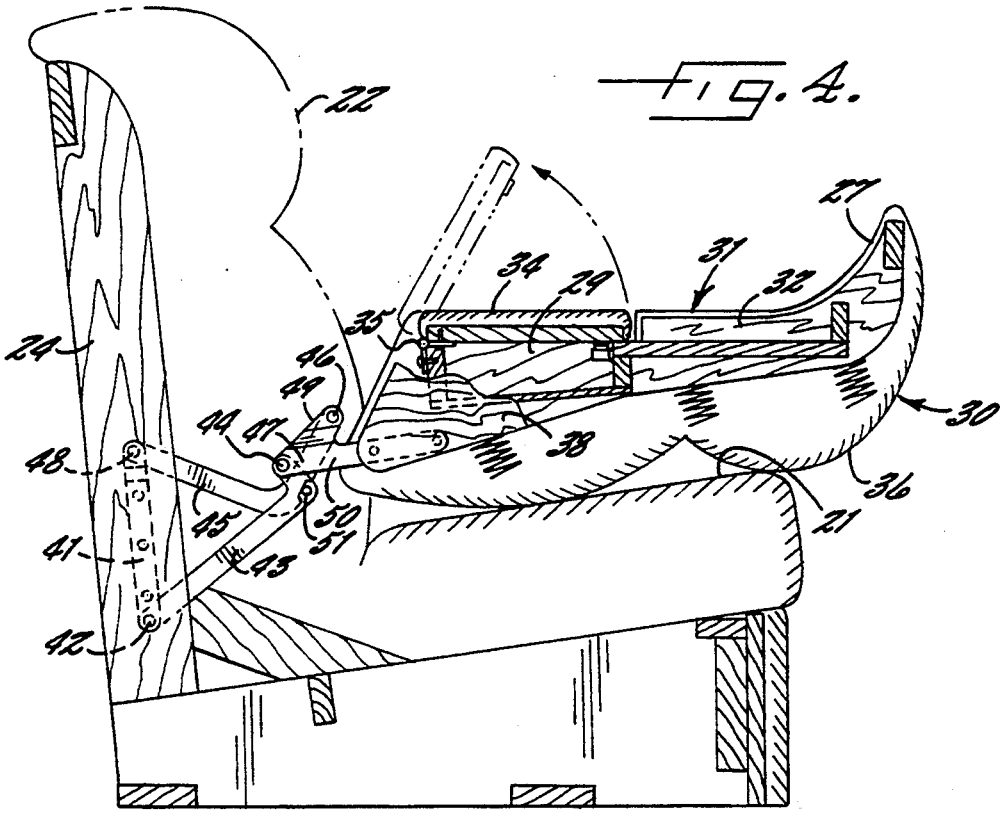
FIG. 4 is a sectional view taken along line 4—4 of FIG. 1 showing a sofa table and mechanism in the open position.

The operation of the sofa table 30 and mechanism 40 can be best understood by comparing its orientation in the closed position shown in FIG. 5 to its orientation in the open position shown in FIG. 4. In FIG. 5, the sofa table 30 is shown in its upright or closed position, with the table arm 50 of the mounting bracket 47 and, accordingly, the upper support surface 31 being disposed generally upright. Note that pivots 48, 46, and 44 are virtually aligned in an "on-center" condition; while not present in this embodiment, one skilled in the art will understand that a true "on-center" condition for these pivots would create a locking mechanism which would help to retain the sofa table 30 in the upright position. As a force is directed forwardly at the top of the sofa table 30, the pivot arm 49 of the mounting bracket 47 rotates about pivot 44 so that the table arm 50 moves downwardly and forwardly. This action causes the upper pivot link 45 to rotate about pivot 48 so that pivot 46 moves upwardly and forwardly and also causes the lower pivot link 43 to rotate about pivot 42 so that pivot 44 moves upwardly and rearwardly. As the rotation of the lower pivot link 43, the upper pivot link 45 and the mounting bracket 47 continue, the upholstered surface 36 of the sofa table 30 rotates forwardly and downwardly to a position where it generally parallels the seat surface 21 of the sofa 20. This motion continues until the lower pivot link 43 and the upper pivot link 45 rotate to a position wherein the stop pin 51 of the lower pivot link 43 contacts the upper pivot link 45, at which point rotation ceases. During operation, the upper support surface 31 of the sofa table 30 and the table arm 50 of the mounting bracket 47 each rotate from a first rotative orientation in the closed position to a second rotative orientation in the open position which is generally between about 75 and 120 degrees from the first rotative position.

It should be noted that, as is clear in FIG. 4, when the sofa table 30 is in the open position, the entirety of the mechanism 40 is disposed below a plane defined by the upper support surface 31 of the sofa table 30. This orientation provides a much more appealing seating unit when viewed by an observer facing the front of the sofa 30, as all of the linkages of the mechanism 40 are hidden from view.

Figure 6:
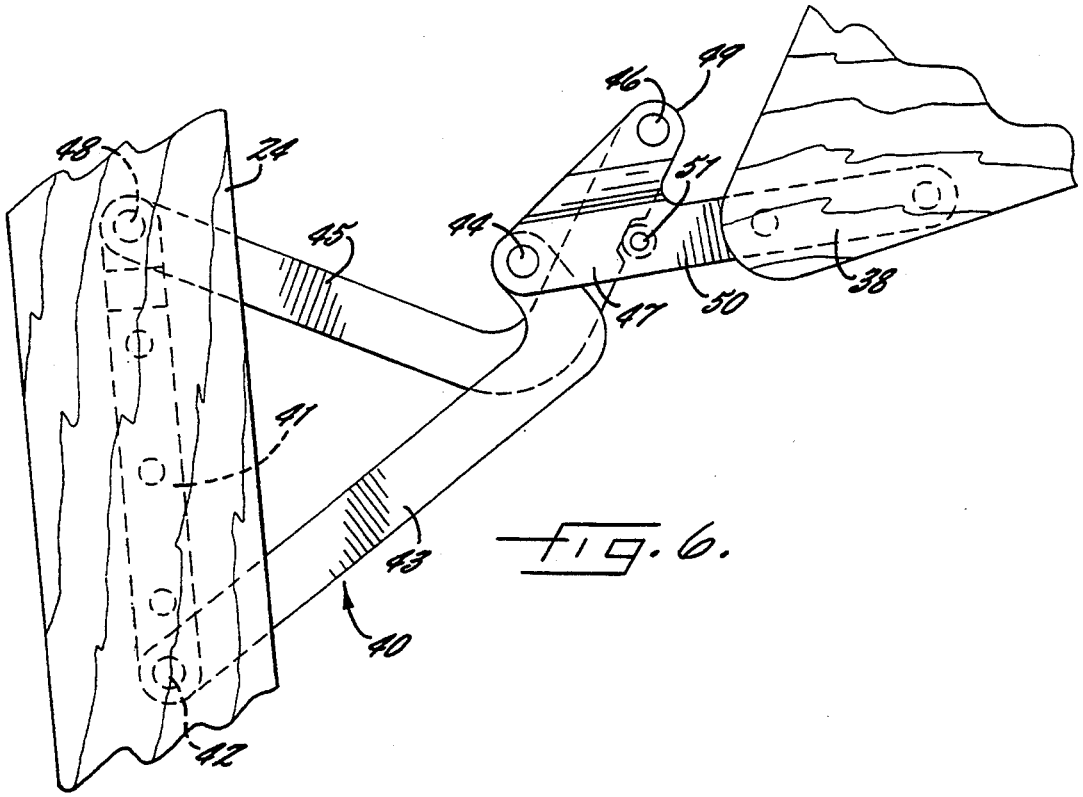
FIG. 6 shows an enlarged side view of an alternative embodiment of the sofa table mechanism in the open position, wherein the stop pin is located on the mounting bracket.
Figure 7:
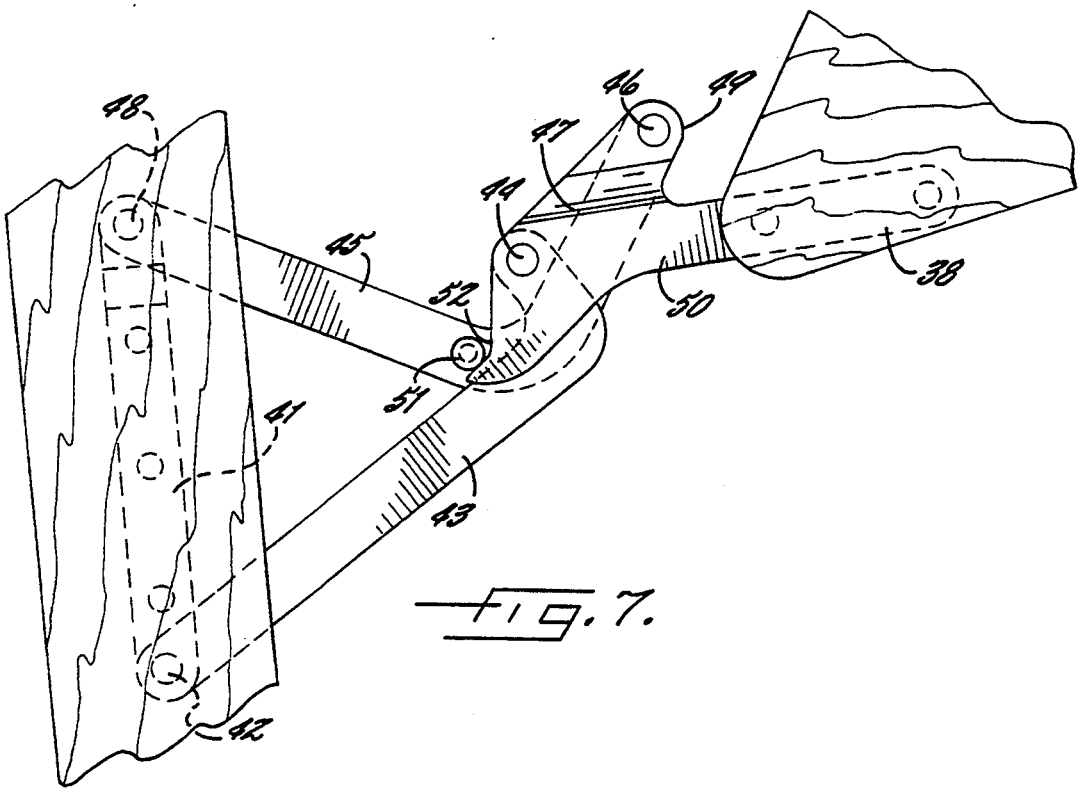
FIG. 7 shows an enlarged side view of an alternative embodiment of the sofa table mechanism wherein the stop pin is located on the upper pivot link.

FIG. 6 shows an alternative embodiment of the mechanism 40 wherein the stop pin 51 is located on the table arm 50 of the mounting bracket 47 rather than on the lower pivot link 43. In this embodiment, the other links retain the same configuration as in the embodiment in FIGS. 1–5. FIG. 7 shows another alternative embodiment, wherein the stop pin 51 is located on the upper pivot link 45. In this embodiment the shape of the mounting bracket 47 is altered slightly to include a bearing surface 52 which contacts the stop pin 51 to cease motion of the sofa table 30.

The drawings and specification disclose typical preferred embodiments of the invention, and, although specific terms are employed, they are used in a generic and descriptive sense only and not for the purpose of limitation, the scope of the invention being set forth in the following claims.

That which is claimed is:

1. A seating unit comprising:

(a) a seat frame including a seat having a substantially horizontal seat surface, a backrest having a substantially upright and forwardly facing backrest surface, said backrest surface having a recessed area, and mounting panels fixed rearward of said recessed area;

(b) a table section comprising:

i) a decorative surface;

ii) a support surface having a rearward edge; and iii) a pair of mechanism mounting panels located below said support surface;

said table section being movable between a generally upright closed position, in which said table section is nested within said recessed area with said decorative surface facing forward, and a generally horizontal open position, in which said decorative surface faces and is adjacent said seat surface and said support surface faces upwardly; and (c) a pair of mechanisms for moving said table section between the open position and the closed position, each of said pair of mechanisms comprising:

i) means for mounting said mechanism to said mounting panels;

ii) a lower pivot link pivotally interconnected to said mounting means:

iii) a table mounting bracket pivotally interconnected to said lower pivot link and fixed to one of said pair of mechanism mounting panels; and iv) an upper pivot link having a first portion pivotally interconnected to said mounting means upwardly of the pivot of said mounting means and said lower pivot link, and further having a second portion pivotally interconnected to said table mounting bracket, said first portion being fixed to said second portion;

said upper pivot link being configured so that in the closed position, said first portion of said upper pivot link is disposed rearward of said rearward edge of said support surface of said table section, and said second portion of said upper pivot link is disposed below said rearward edge of said support surface of said table section.

2. A seating unit according to claim 1, wherein each of said mounting means is attached to each of said mounting panels so that when said table section is in the open position, said mounting means is disposed beneath a plane defined by said support surface.

3. A seating unit according to claim 1, wherein said first portion of said upper pivot link and said second portion of said upper pivot link form an L-shaped link.

4. A seating unit according to claim 1, wherein said mounting means comprises a mounting link.

5. A seating unit according to claim 4, wherein said halting means is fixed to said mounting bracket.

6. A seating unit according to claim 4, wherein said halting means is fixed to said upper pivot link.

7. A seating unit according to claim 1, wherein said mechanism further comprises means for halting downward movement of said table section from the open position.

8. A seating unit according to claim 1, wherein said table section further comprises a pair of armrests on opposed lateral edges of said table section.

9. A seating unit according to claim 1, wherein said support surface further comprises a vertically recessed area.

10. A seating unit according to claim 1, wherein said support surface further comprises a storage compartment.

11. A seating unit comprising:

(a) a seat frame including a seat having a substantially horizontal seat surface, a backrest having a substantially upright and forwardly facing backrest surface, said backrest surface having a recessed area, and mounting panels fixed rearward of said recessed area;

(b) a table section comprising:

i) an upholstered surface;

ii) a support surface having a rearward edge; and iii) a pair of mechanism mounting panels located below said support surface;

said table section being movable between a generally upright closed position, in which said table section is nested within said recessed area with said upholstered surface facing forward, and a generally horizontal open position, in which said upholstered surface faces and is adjacent said seat surface and said support surface faces upwardly; and (c) a pair of mechanisms for moving table section between the open position and the closed position, each of said pair of mechanisms comprising:

i) means for mounting said mechanism to said mounting panels;

ii) a lower pivot link pivotally interconnected to said mounting means at a first pivot;

iii) a table mounting bracket pivotally interconnected to said lower pivot link and fixed to one of said pair of mechanism mounting panels; and iv) an upper pivot link pivotally interconnected to said mounting means at a second pivot, said second pivot being positioned upwardly of said first pivot, and further pivotally interconnected to said table mounting bracket;

said mounting means being attached to said mounting panels so that, when said table section is in the open position, said second pivot is positioned beneath a plane defined by said support surface.

12. A seating unit according to claim 11, wherein said upper pivot link comprises an L-shaped link.

13. A seating unit according to claim 11, wherein said mounting means comprises a mounting link.

14. A seating unit according to claim 11, wherein said mechanism further comprises means for halting downward movement of said table section from the open position.

15. A seating unit according to claim 14, wherein said halting means is fixed to said upper pivot link.

16. A seating unit according to claim 14, wherein said halting means is fixed to said mounting bracket.

17. A seating unit comprising:

(a) a seat frame including a seat having a substantially horizontal seat surface, a backrest having a substantially upright and forwardly facing backrest surface, said backrest surface having a recessed area, and mounting panels fixed rearward of said recessed area;

(b) a table section comprising:

i) an upholstered surface;

ii) a support surface having a rearward edge; and iii) a pair of mechanism mounting panels located below said support surface;

said table section being movable between a generally upright closed position, in which said table section is nested within said recessed area with said upholstered surface facing forward, and a generally horizontal open position, in which said upholstered surface faces and is adjacent said seat surface and said support surface faces upwardly; and (c) a pair of mechanism for moving said table section between the open position and the closed position, each of said pair of mechanisms comprising:

i) means for mounting said mechanism to said mounting panels;

ii) a lower pivot link pivotally interconnected to said mounting means at a first pivot;

iii) a table mounting bracket pivotally interconnected to said lower pivot link and fixed to one of said pair of mechanism mounting panels; and iv) an upper pivot link pivotally interconnected at a second pivot to said mounting means, said second pivot being located upwardly of said first pivot, and further pivotally interconnected to said table mounting bracket, said upper pivot link being substantially I-shaped;

said mounting means being attached to said mounting panels so that, when said table section is in the open position, said second pivot is positioned beneath a plane defined by said support surface.

18. A seating unit according to claim 17, wherein said mounting means comprises a mounting link.

19. A seating unit according to claim 17, wherein said mechanism further comprises means for halting downward movement of said table section from the open position.

20. A seating unit according to claim 19, wherein said halting means is fixed to said upper pivot link.

21. A seating unit according to claim 19, wherein said halting means is fixed to said mounting bracket.

22. A mechanism suitable for use with a retractable sofa table comprising:

(a) means adapted for mounting said mechanism to a sofa frame;

(b) a lower pivot link pivotally interconnected to said mounting means;

(c) a table mounting bracket pivotally interconnected to said lower pivot link and fixed to said table section; and (d) a upper pivot link pivotally interconnected to said mounting means, and further pivotally interconnected with said table mounting bracket, said upper pivot link comprising a bend between its pivots, said bend being disposed towards said lower pivot link and being substantially L-shaped;

so that in a first closed position, said table mounting bracket is in a first rotative position relative to said mounting means, and in a second open position, said table mounting bracket is in a second rotative position relative to said mounting means which is between about 75 and 120 degrees from the first rotative position.

23. A mechanism according to claim 22, wherein said mounting means comprises a mounting link.

24. A mechanism according to claim 22, wherein said mechanism further comprises means for halting angular movement of said table mounting bracket so that said table mounting bracket is unable to rotate about said lower pivot link away from the closed position to a rotative position beyond the open position.

25. A mechanism according to claim 24, wherein said halting means is fixed to said table mounting bracket.

26. A mechanism according to claim 24, wherein said halting means is fixed to said upper pivot link.

* * * * *